US005131364A

United States Patent [19]

Mann

[11] Patent Number: 5,131,364

[45] Date of Patent: Jul. 21, 1992

[54] THROTTLE-VALVE CONNECTION

[75] Inventor: Arnold Mann, Biebergemünd, Fed. Rep. of Germany

[73] Assignee: VDO Adolf Schindling AG, Frankfurt am Main, Fed. Rep. of Germany

[21] Appl. No.: 738,575

[22] Filed: Jul. 31, 1991

[30] Foreign Application Priority Data

Aug. 29, 1990 [DE] Fed. Rep. of Germany ..... 4027269

[51] Int. Cl.[5] ..... F02D 7/00

[52] U.S. Cl. ..... 123/399

[58] Field of Search ..... 123/399, 396, 342, 361, 123/352; 180/177, 197; 74/877

[56] References Cited

U.S. PATENT DOCUMENTS

| | | | |
|---|---|---|---|
| 4,926,821 | 5/1990 | Portor et al. | 123/399 |
| 4,947,815 | 8/1990 | Peter | 123/399 |
| 5,003,948 | 4/1991 | Churchill et al. | 123/352 |
| 5,014,806 | 5/1991 | Hamada | 180/197 |
| 5,018,496 | 5/1991 | Buchl | 123/399 |
| 5,027,766 | 7/1991 | Zendgraf et al. | 123/361 |
| 5,065,721 | 11/1991 | Wiggins et al. | 123/399 |
| 5,074,266 | 12/1991 | Kuhn et al. | 123/361 |
| 5,076,385 | 12/1991 | Terazawa et al. | 180/197 |
| 5,080,064 | 1/1992 | Buslapp et al. | 123/399 |

*Primary Examiner*—Raymond A. Nelli
*Attorney, Agent, or Firm*—Martin A. Farber

[57] ABSTRACT

A setting lever (8) adapted to be turned mechanically is seated in turnable manner on a throttle-valve shaft (2) of a throttle-valve connection (1). A driver arm (12) of the setting lever engages between two legs (10, 11) of a coupling spring (9). Another driver arm (131) which is firmly attached to the throttle-valve shaft (2) also engages between said legs (10, 11). In this way an electric motor (4) which is developed as stepping motor can turn the throttle-valve shaft (2), for instance, on a basis of commands of an anti-slip control or of a speed control, regardless of the position of the setting lever (8).

7 Claims, 1 Drawing Sheet

THROTTLE-VALVE CONNECTION

FIELD AND BACKGROUND OF THE INVENTION

The present invention refers to a throttle-valve connection having a throttle-valve shaft which can be actuated by an electric motor and mechanically by means of a setting lever.

Throttle-valve connections of this type are used in motor vehicles for adjusting the engine output power and are generally known. While formerly displacement of the throttle valve was effected exclusively mechanically via a pull cable upon movement of the accelerator pedal, modern motor vehicles contain control devices which, under given conditions of travel change the engine output power independently of the position of the accelerator pedal. When, as a result of too high an engine output, slippage of the driven wheels may take place on a slippery substrate, the throttle valve must, for instance, be swung in closing direction contrary to the driver's command. In idle operation, the throttle valve is frequently opened beyond the normal idle position so that a higher power requirement resulting, for instance, from a turning on of the air conditioner can be satisfied. In the case of an automatic speed control, the throttle valve must be capable of being displaced in both directions independently of the accelerator pedal.

In the throttle-valve connections known up to the present time, a clutch is provided between the setting lever and the electric motor, the clutch connecting the electric motor to the throttle-valve shaft upon a control action by the electric motor. Such a clutch results in additional structural expense and may give rise to a failure of the control. Furthermore, the time required until a control action takes effect is increased by the clutch since the clutch must first be closed prior to the displacement of the throttle-valve shaft by the motor.

SUMMARY OF THE INVENTION

It is an object of the invention so to develop a throttle-valve connection of the aforementioned type that displacement mechanically and by the electric-motor is possible in the simplest and most reliable manner possible.

According to the invention, the electric motor (e.g. 4) is a stepping motor which is arranged, without the interposition of a clutch, on the throttle-valve shaft (2) and the setting lever (8) is connected to the throttle-valve shaft (2) by a coupling spring (9).

Such a stepping motor can rotate with rotation of the throttle-valve shaft upon the mechanical actuation of the throttle-valve shaft, since modern stepping motors are practically free of force when current is not passing through them. By the use of the stepping motor, a clutch is dispensed with. Furthermore, it is not necessary to provide a gearing and a potentiometer for the monitoring of the position of the throttle-valve shaft. Only zero-position monitoring is necessary. By the invention there is obtained a simplified construction of the throttle-valve connection, a reduction in the structural size, high resistance to vibration, and assurance against disturbances. The mounting of the throttle-valve connection is simplified as compared with the known throttle-valve connections since a plug-in mounting is possible.

The coupling spring (9) is of particularly simple development if it has two spring legs (10, 11) between which there engage a driver arm (13), which is connected fixed for rotation with the throttle-valve shaft (2), and a driver arm (12) of the setting lever (8).

For further simplification of the throttle-valve connection, the setting lever (8) may be mounted rotatably on the throttle-valve shaft (2).

Further to simplify the construction of the throttle-valve connection, the setting lever (8) may, in accordance with another embodiment of the invention, be mounted by means of a hub (7) on a pin (6) of the throttle-valve shaft (2), and the coupling spring (9) may be a leg spring which is wrapped around the hub (7).

The power ordered by the driver can be detected in simple manner if the driver arm (12) of the setting lever (8) is provided on its two opposite sides, each facing one spring leg (10, 11), with a switch contact (14, 15) for recognizing the command of the driver.

Contacts for the anti-slip control and speed control can be dispensed with if the stepping motor (4) is connected to the throttle-valve shaft (2) via a driver connection (5) which permits a play of 90°.

BRIEF DESCRIPTION OF THE DRAWING

With the above and other objects and advantages in view, the present invention will become more clearly understood in connection with the detailed description of a preferred embodiment when considered with the accompanying drawing, of which.

DETAILED DESCRIPTION OF THE PREFERRED EMBODIMENT

Figure 1:
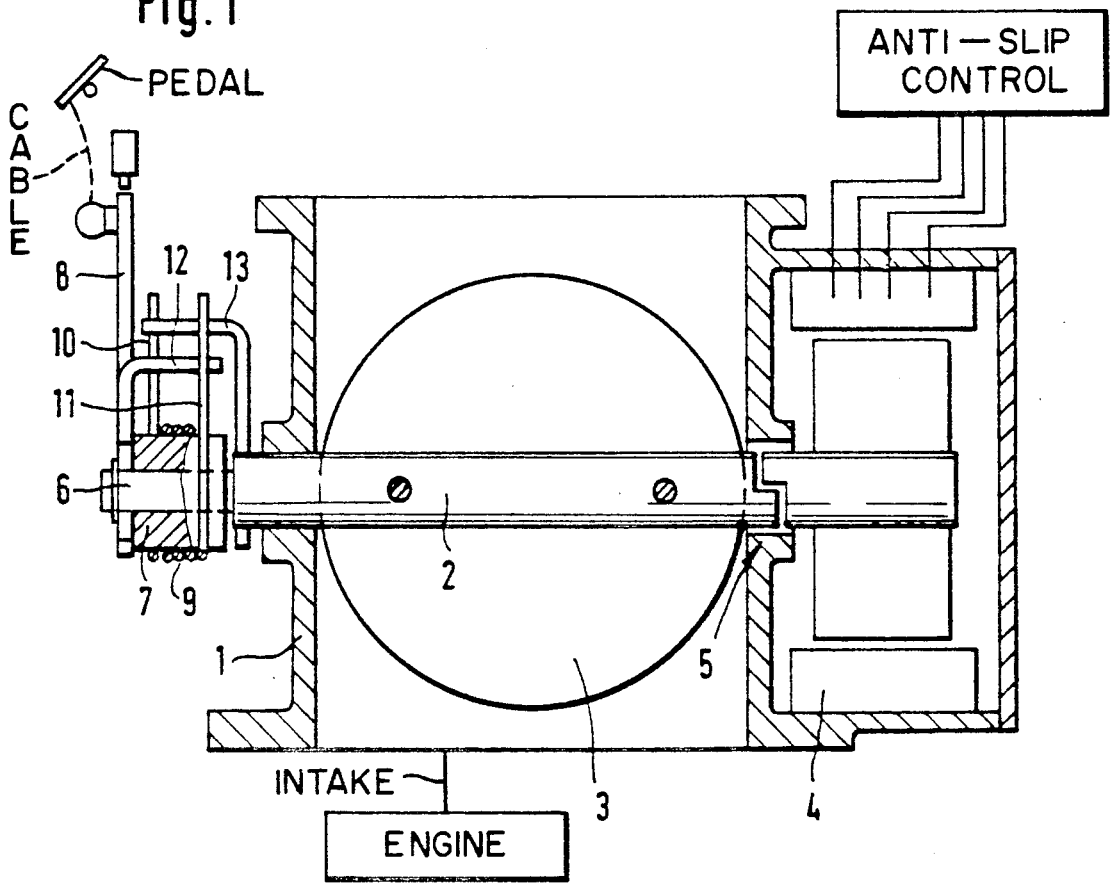
FIG. 1 is a longitudinal section through a throttle-valve connection developed in accordance with the invention.

FIG. 1 shows a throttle-valve body or connection 1 in which a throttle-valve shaft 2 is rotatably mounted. This throttle-valve shaft 2 bears a throttle valve 3 in customary manner.

The throttle-valve shaft 2 can be displaced by an electric motor 4 developed as stepping motor. The electric motor 4 makes it possible to turn the throttle-valve shaft 2 directly, without the interposition of a clutch. In FIG. 1, however, a driver connection 5 is shown which permits 90° play between the electric motor 4 and the throttle-valve shaft 2.

On the side of the throttle-valve shaft 2 opposite the electric motor 4 the shaft has a pin 6 on which there is rotatably mounted a hub 7 which bears, fixed for rotation, a setting lever 8 which can be swung in customary manner by means of a pull cable which is actuated from the accelerator pedal. Around the hub 7 there is wound a coupling spring 9 which has two legs 10, 11 which point upward in FIG. 1 and between which a driver arm 12 of the setting lever 8 and a driver arm 13 of the throttle-valve shaft 2 engage. The driver arm 12 is firmly connected with the setting lever 8 and the driver arm 13 is connected with the throttle valve shaft 2 so as to be capable of rotation with the shaft 2 but not independently thereof. Upon a swinging of the setting lever 8, the driver arms 12, 13 transmit the swinging motion to the throttle-valve shaft 2 so that the latter is swung in synchronism with the setting lever 8.

If current passes through the electric motor 4, the latter can turn the throttle-valve shaft 2 regardless of the position of the setting lever 8 in the manner that leg 11 or 10 is swung, depending on the direction of rotation, by the driver arm 13.

Figure 2:
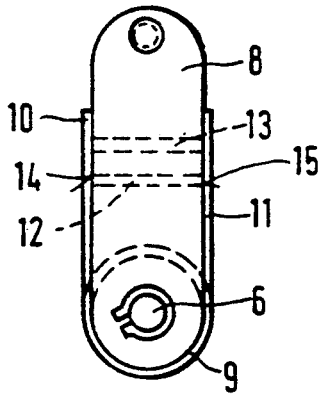
FIG. 2 is a front view of a setting lever of the throttle-valve connection with adjoining structural parts.

FIG. 2 shows the setting lever 8 mounted on the pin 6 and the two legs 10, 11 of the leg spring 9. The driver arms 12, 13, between which the legs 10, 11 engage, are shown in dashed line in FIG. 2. On the opposite sides of the driver arm 12 which is connected to the setting lever 8 there is provided in each case an electric switch contact 14, 15. If the setting lever 8 swings to the right as seen in FIG. 2, the contact 15 contacts the leg 11. If the setting lever 8 swings to the left, than the contact 14 contacts the leg 10. In this way, it can be determined whether the driver commands greater or lesser power of the engine by a corresponding actuation of the accelerator pedal.

I claim:

1. A throttle-valve connection comprising a throttle-valve shaft, a coupling spring, an electric motor, and a setting lever, the shaft being actuated by the motor and mechanically by means of the lever; and wherein the electric motor is a stepping motor which is connected continuously in clutchless connection to the throttle-valve shaft; and the setting lever is connected to he throttle-valve shaft by the coupling spring.

2. A throttle-valve connection according to claim 1, further comprising a first driver arm connected fixed for rotation with the throttle-valve shaft, a setting lever, and a second driver arm of the setting lever; and wherein the coupling spring has two spring legs between which there engage the first driver arm and the second driver arm.

3. A throttle-valve connection according to claim 2, wherein the setting lever is rotatably mounted on the throttle-valve shaft.

4. A throttle-valve connection according to claim 1, wherein the setting lever is rotatably mounted on the throttle-valve shaft.

5. A throttle-valve connection according to claim 2, further comprising a hub, the throttle-valve shaft including a pin; and wherein the setting lever is mounted by means of the hub on the pin of the throttle-valve shaft; and the coupling spring is a leg spring which is wrapped around the hub.

6. A throttle-valve connection according to claim 2, further comprising switch contacts; and wherein the driver arm of the setting lever is provided on its two opposite sides, each facing one spring leg, with the switch contacts for recognizing the command of a driver.

7. A throttle-valve connection according to claim 1, further comprising a driver connection; and wherein the stepping motor is connected to the throttle-valve shaft via the driver connection, the driver connection permitting a play of 90°.

* * * * *